US010030875B2

(12) United States Patent
Leikam et al.

(10) Patent No.: US 10,030,875 B2
(45) Date of Patent: Jul. 24, 2018

(54) COOKING HOB WITH ONCE-PIECE FASTENING ELEMENTS AND A ONE-PIECE FASTENING ELEMENT FOR A COOKING HOB

(75) Inventors: Jurgen Leikam, Hilpoltstein (DE); Theo Hauer, Rothenburg o. d. Tauber (DE); Alwin Neukamm, Wilhermsdorf (DE)

(73) Assignee: Electrolux Home Products Corporation N.V., Brussels (BE)

( * ) Notice: Subject to any disclaimer, the term of this patent is extended or adjusted under 35 U.S.C. 154(b) by 2379 days.

(21) Appl. No.: 12/937,785

(22) PCT Filed: Apr. 16, 2009

(86) PCT No.: PCT/EP2009/002769

§ 371 (c)(1),
(2), (4) Date: Oct. 14, 2010

(87) PCT Pub. No.: WO2009/143936

PCT Pub. Date: Dec. 3, 2009

(65) Prior Publication Data

US 2011/0030669 A1 Feb. 10, 2011

(30) Foreign Application Priority Data

Apr. 18, 2008 (EP) ..... 08007559

(51) Int. Cl.
*F24B 5/08* (2006.01)
*F24C 15/10* (2006.01)
(Continued)

(52) U.S. Cl.
CPC ..... *F24C 15/102* (2013.01); *F24C 3/124* (2013.01); *F24C 7/082* (2013.01); *F24C 15/108* (2013.01)

(58) Field of Classification Search
CPC ..... F24C 15/108; F24C 15/102; F24C 3/12; H05B 3/06
(Continued)

(56) References Cited

U.S. PATENT DOCUMENTS 2,213,234 A * 9/1940 Tinnerman ..... 403/42
2,328,757 A * 9/1943 Tinnerman ..... 49/463
(Continued)

FOREIGN PATENT DOCUMENTS

DE 9004720 6/1990
DE 9108044 7/1992
(Continued)

OTHER PUBLICATIONS

International Search Report for PCT/EP2009/002769, dated Feb. 17, 2010, 3 pages.

*Primary Examiner* — Jason Lau
(74) *Attorney, Agent, or Firm* — Pearne & Gordon LLP

(57) ABSTRACT

The present invention relates to a cooking hob (10) with at least two one-piece fastening elements (20) arranged at outer portions of the cooking hob (10). The fastening element (20) comprises a first portion (22) being permanently connected or connectable to an upper part (12) of the cooking hob (10). The fastening element (20) comprises a second portion (24) being detachably connected or connectable to a lower part (14) of the cooking hob (10), so that the upper part (12) and the lower part (14) form the cooking hob (10). The second portion (24) of the fastening element (20) comprises at least one spring element (26) at a sidewall of the cooking hob (10) in order to clamp the cooking hob (10) within a cutout (34) enclosing circumferentially the cooking hob (10). At least two fastening elements (20) are arranged at opposite sidewalls of the cooking hob (10). Further, the present invention relates to a one-piece fastening element.

8 Claims, 4 Drawing Sheets

Figure 1:
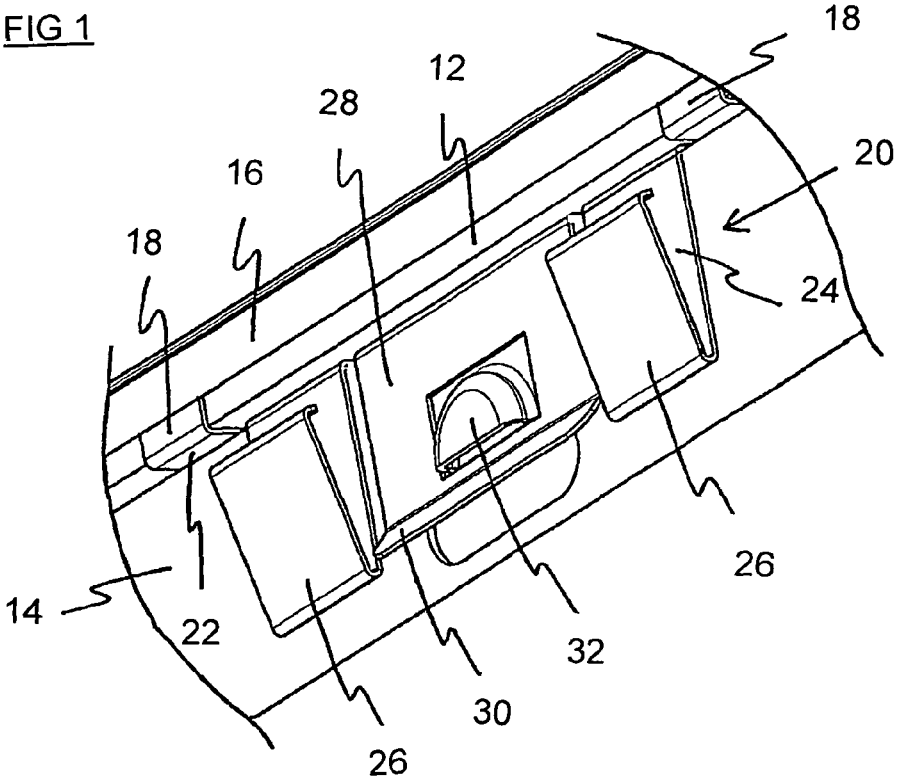

(51) Int. Cl.
*F24C 3/12* (2006.01)
*F24C 7/08* (2006.01)

(58) Field of Classification Search
USPC ..... 126/1 R, 211
See application file for complete search history.

(56) References Cited

U.S. PATENT DOCUMENTS

| | | | | |
|---|---|---|---|---|
| 3,622,754 | A * | 11/1971 | Hurko | 219/448.17 |
| 4,453,533 | A * | 6/1984 | Scheidler et al. | 126/211 |
| 6,924,465 | B2 * | 8/2005 | Schilling et al. | 219/445.1 |
| 2005/0235982 | A1 * | 10/2005 | Gama et al. | 126/39 BA |
| 2007/0169770 | A1 * | 7/2007 | Kuwamura | 126/211 |
| 2009/0127247 | A1 * | 5/2009 | Adam et al. | 219/452.11 |

FOREIGN PATENT DOCUMENTS

| | | | |
|---|---|---|---|
| DE | 9416466 | | 12/1994 |
| DE | 19835140 | | 2/2000 |
| DE | 19835140 | A1 * | 2/2000 |
| EP | 0570669 | | 11/1993 |
| EP | 2116775 | | 11/2009 |
| EP | 2144009 | | 1/2010 |

* cited by examiner

COOKING HOB WITH ONCE-PIECE FASTENING ELEMENTS AND A ONE-PIECE FASTENING ELEMENT FOR A COOKING HOB

The present invention relates to a cooking hob with at least two one-piece fastening elements according to claim 1. Further, the present invention relates to a fastening element for a cooking hob according to claim 7.

A cooking hob has to be fastened within a cutout, which supports and/or surrounds said cooking hob. The cutout is arranged directly in a worktop of a cabinet in a kitchen. Typically, the cooking hob is fastened within the cutout by screw fastenings.

DE 198 35 140 A1 discloses a cooking hob provided for the cutout within the worktop of a cabinet. The device for fastening the cooking hob in the cutout comprises multiple different elements. The installation of the cooking is very complex.

It is an object of the present invention to provide a cooking hob and according fastening elements, which allow an easy installation of the cooking hob in the cutout of the worktop.

The object of the present invention is achieved by the cooking hob according to claim 1.

The present invention relates to a cooking hob with at least two one-piece fastening elements arranged at outer portions of the cooking hob, wherein:

- the fastening element comprises a first portion being permanently connected or connectable to an upper part of the cooking hob,
- the fastening element comprises a second portion being detachably connected or connectable to a lower part of the cooking hob,
- so that the upper part and the lower part form the cooking hob,
- the second portion of the fastening element comprises at least one spring element at a side wall of the cooking hob in order to clamp the cooking hob within a cutout enclosing circumferentially the cooking hob, and
- at least two fastening elements are arranged at opposite sidewalls of the cooking hob.

The main idea of the present invention is the cooking hob with at least two one-piece fastening elements, wherein said fastening element is provided to connect the upper art of the cooking hob to the lower part of the cooking hob on the one hand and to fasten the cooking hob within a cutout on the other hand. The geometric form of the fastening element allows two different connections with one single fastening element. The upper part is permanently connected to the fastening element. The lower part is detachably connected to the fastening element. The resulting cooking hob is then connectable to the cutout by the same fastening element. At least two fastening elements at opposite sidewalls of the cooking hob are sufficient for a stable installation of the cooking top within the cutout:

In particular, the upper part of the cooking hob is a glass-ceramic panel. Since the lower part of the cooking top is usually made of another material, e.g. steel, the adjusting element allows an easy and stable connection between the glass-ceramic panel and the lower part of the cooking top.

Preferably, the first portion of the fastening element is glued or glueable at the upper part of the cooking hob.

Further, the first portion of the fastening element may comprise a bending for supporting at least a section of a circumferential side of the upper part. Thus, the position of the fastening element at the upper part may be definitely determined.

According to the preferred embodiment of the present invention the fastening element may comprise at least one latch element. The latch element allows an easy assembling of the upper and lower part.

Further, the lower part of the cooking hob may comprise at least one lug element engaged or engageable with a recess in the latch element. The lug element and the associated recess allow a stable connection. Preferably, the lug element is arranged at a circumferential side of the lower part of the cooking hob.

In particular, the latch element comprises a buckled appendix acting as a grip, wherein said appendix is provided for releasing the latch element from the lug element. Thus, the connection between the upper and lower part may be easily released.

For example, the spring element may have a U-shaped form. This is a simple and efficient construction of the spring element. Preferably, the spring element is a leaf-spring.

According to one embodiment of the present invention the circumferences of the upper part and the lower part of the cooking hob are marginally smaller than the circumference of the cutout. The cooking hob may be completely countersunk within the worktop. In particular, the topsides of the upper part and the worktop can be arranged at the same level.

Alternatively, the circumference of the upper part is marginally bigger and the circumference of the lower part of the cooking hob is marginally smaller than the circumference of the cutout. In this case, the worktop supports directly the upper part and indirectly also the lower part of the cooking hob. No further support elements are required in this case.

Further, the cooking hob comprises at least one design element enclosing at least partially the upper part of the cooking hob along the circumference of said upper part. With the design element the cooking hob may adapted to the design of the kitchen.

According to a further aspect of the invention the cooking hob comprises at least one casing for an electric or electronic circuitry arranged at the bottom side of the upper part of the cooking hob. This is a contribution to a compact construction of the cooking hob.

Especially, the casing comprises one open side covered by the bottom side of the upper part of the cooking hob. This allows an easy construction with low costs.

According to the preferred embodiment of the present invention a sealing strip is arranged between the casing and the bottom side of the upper part. The bottom side of the upper part, the casing and the sealing strip form a leakproof space by a simple way.

In order to allow a low cost production the sealing strip may be applied onto the bottom side of the upper part as a fluid or a viscous paste. Preferably, the sealing strip is made of a foamed material.

In particular, the casing is made of plastics. This allows a production with low costs. The casing can be adapted to the form of the electric or electronic circuitry and other components.

The object of the present invention is further achieved by the fastening element according to claim 7.

The present invention relates to a one-piece fastening element for a cooking hob, wherein:

the fastening element comprises a first portion being permanently connectable to an upper part of the cooking hob, the fastening element comprises a second portion being detachably connectable to a lower part of the cooking hob, so that the upper part and the lower part form the cooking hob, and the second portion of the fastening element comprises at least one spring element provided for a sidewall of the cooking hob in order to clamp the cooking hob within a cutout enclosing circumferentially the cooking hob.

The main idea of the present invention is the one-piece fastening element, which is provided to connect the upper part of the cooking hob to the lower part of the cooking hob on the one hand and to adjust the resulting cooking hob within a cutout on the other hand. The geometric form of the fastening element allows two different connections with one single fastening element. The upper part of the cooking hob is permanently connected to the fastening element. The lower part of the cooking hob is detachably connected to the fastening element. The resulting cooking hob is then connectable to the cutout by the same fastening element.

Further, the first portion of the fastening element is glueable at the upper part of the cooking hob. In particular, the first portion of the fastening element is glueable at a glass-ceramic panel.

Preferably, the first portion of the fastening element comprises a bending for supporting at least a section of a circumferential side of the upper part or the glass-ceramic panel, respectively. Thus, the position of the fastening element at the upper part or the glass-ceramic panel, respectively, may be definitely determined.

According to the preferred embodiment of the present invention the fastening element comprises at least one latch element. The latch element may include a recess engageable with a lug element at a circumferential side of the lower part of the cooking hob.

In particular, the latch element comprises a buckled appendix acting as a grip, wherein the appendix is provided for releasing the latch element from the lug element. Thus, the connection between the upper and lower part may be easily released.

For example, the spring element may have a U-shaped form. This is a simple and efficient construction of the spring element. Preferably, the spring element is a leaf-spring.

Additionally, the substantial parts of the first portion and the second portion forma right angle. The preferred embodiment of the inventive fastening element has substantially the form of an L-profile. This form is adapted to the upper and lower part. The horizontal first portion is adapted to the flat upper part. The vertical second portion is adapted to the sidewalls of the lower part.

At last, the fastening element according to the present invention is provided for the cooking hob as described above.

The novel and inventive features believed to be the characteristic of the present invention are set forth in the appended claims.

Figure 2:
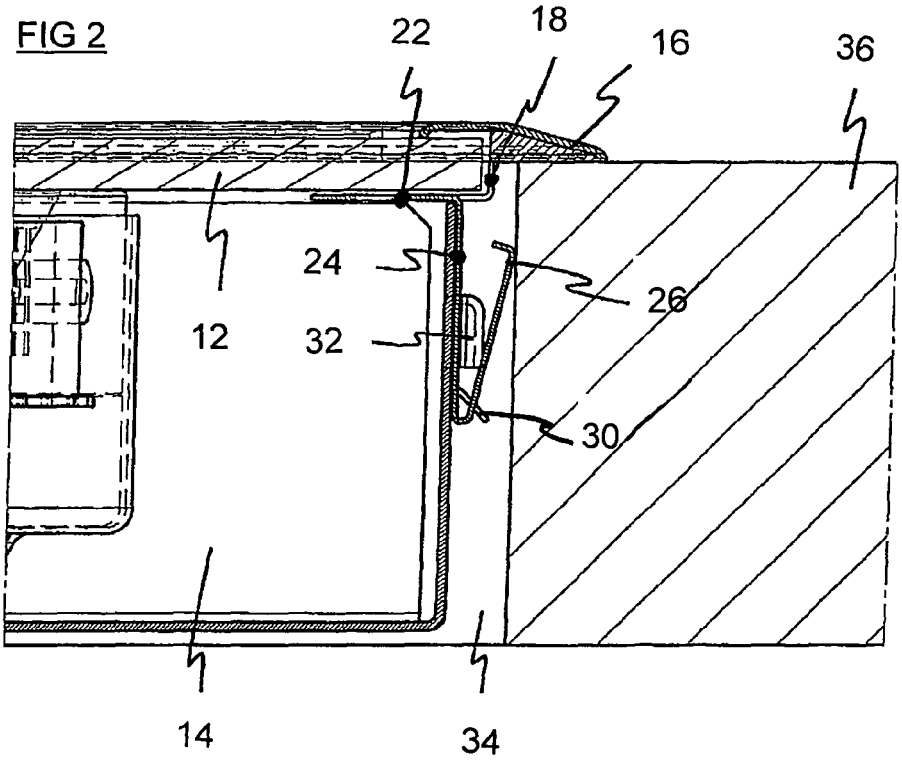
Figure 3:
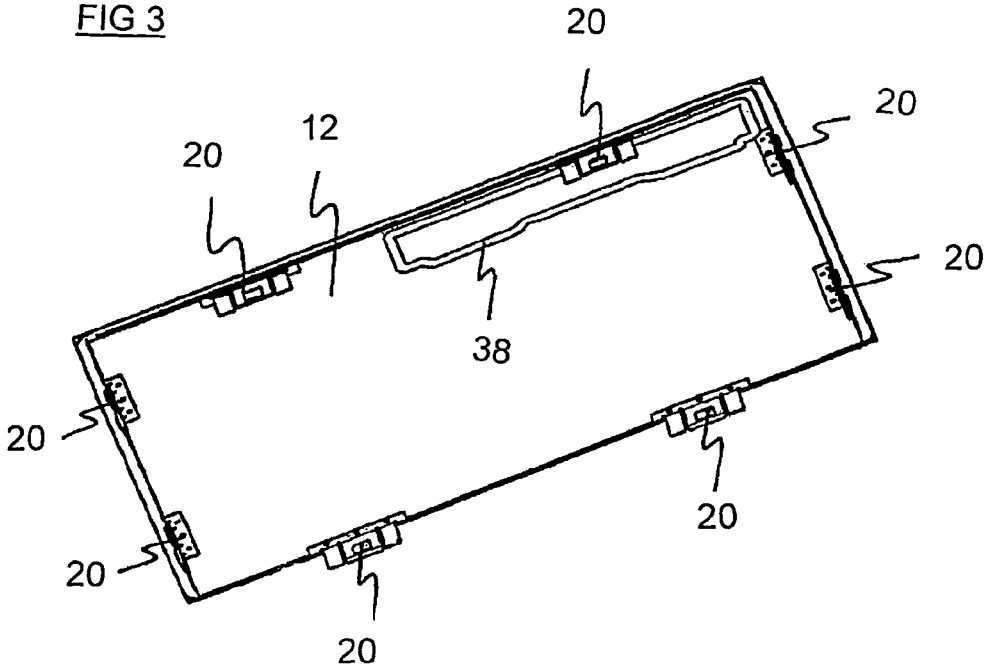
Figure 4:
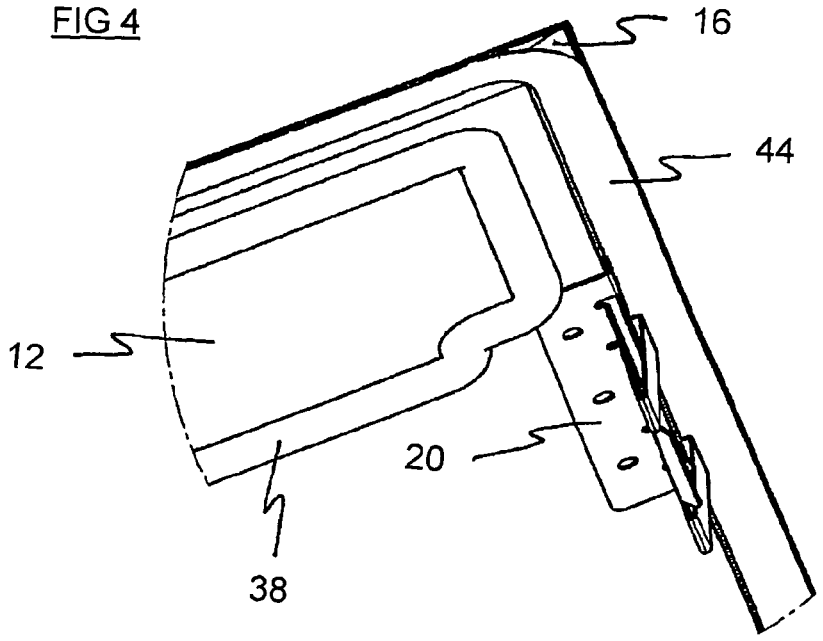
Figure 5:
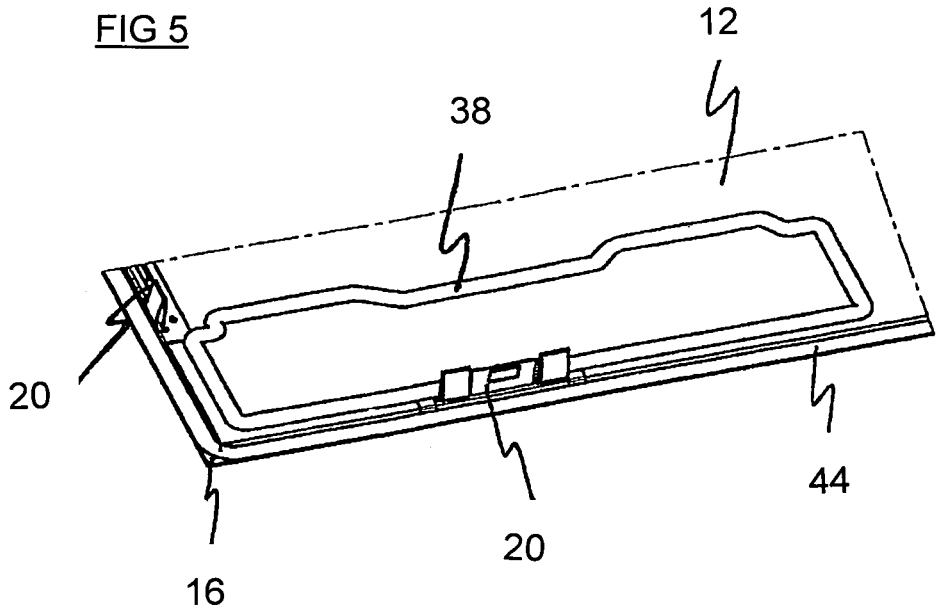
Figure 6:
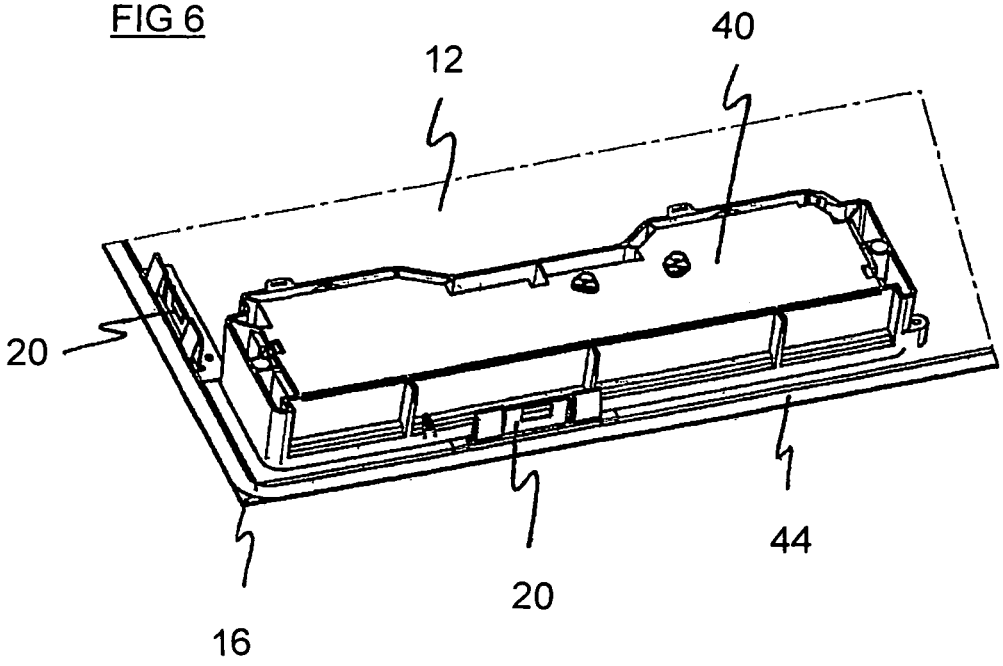
Figure 7:
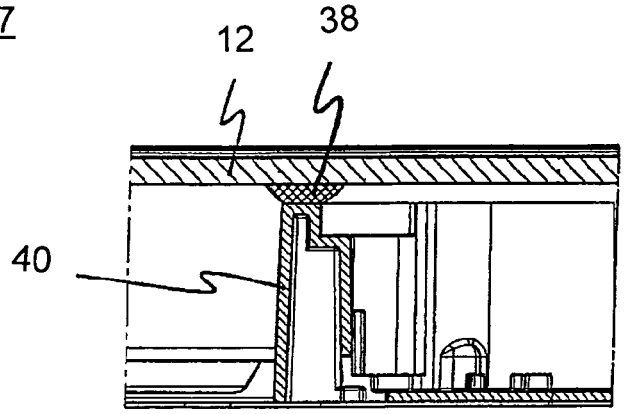
Figure 8:
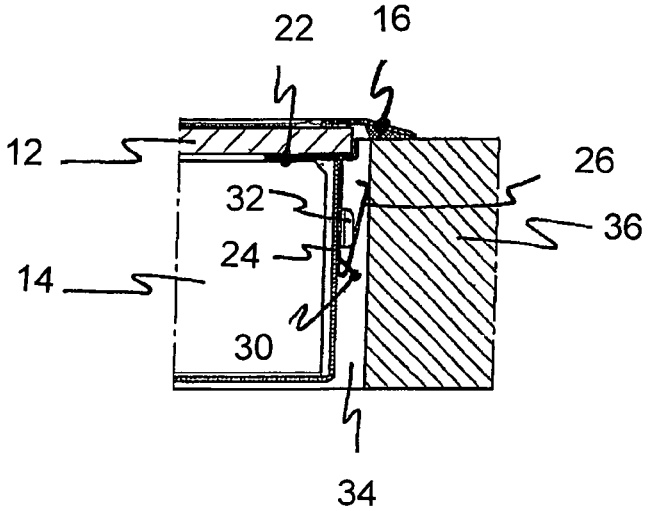
Figure 9:
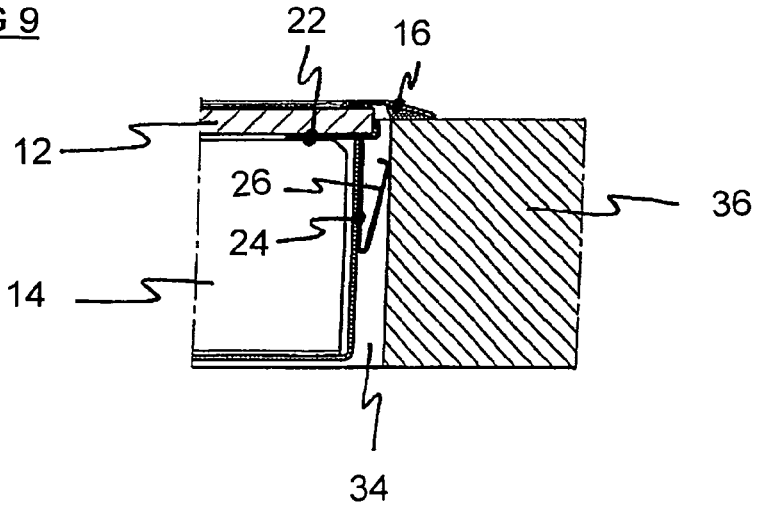

The invention will be described in further detail with reference to the drawing, in which FIG. 1 illustrates a schematic diagram of a perspective view of a fastening element arranged at a cooking hob according to a preferred embodiment of the present invention, FIG. 2 illustrates a schematic diagram of a sectional side view of the fastening element arranged at the cooking hob within a cutout according to the preferred embodiment of the present invention, FIG. 3 illustrates a schematic diagram of a perspective view from a bottom side of an upper part of the cooking hob with a number of fastening elements according to the preferred embodiment of the present invention, FIG. 4 illustrates a detailed schematic diagram of the perspective view from the bottom side of the upper part of the cooking hob with one of the fastening elements according to FIG. 3, FIG. 5 illustrates a detailed schematic diagram of the perspective view of the upper part of the cooking hob with two of the fastening elements according to FIG. 3, FIG. 6 illustrates a detailed schematic diagram of the perspective view of the upper part of the cooking hob with the two fastening elements and a casing according to FIG. 5, FIG. 7 illustrates a schematic diagram of a partial sectional view of the casing arranged at the upper part of the cooking hob according to the preferred embodiment of the present invention, FIG. 8 illustrates a schematic diagram of a sectional side view in a position of a fore spring element showing the fastening element arranged at the cooking hob within the cutout according to the preferred embodiment of the present invention, and FIG. 9 illustrates a schematic diagram of a sectional side view in a position of a rearmost spring element showing the fastening element arranged at the cooking hob within a cutout according to the preferred embodiment of the present invention.

FIG. 1 illustrates a schematic diagram of a perspective view of a fastening element 20 arranged at a cooking hob 10 according to a preferred embodiment of the present invention. The cooking hob 10 comprises an upper part 12, a lower part 14 and a design element 16. The fastening element 20 comprises a first portion 22 and a second portion 24.

In FIG. 1 the bigger part of the first portion 22 is hidden between the upper part 12 and the lower part 14 of the cooking hob 10. The first portion 22 of the fastening element 20 is formed as a plane sheet extending in a horizontal plane. The first portion 22 is fixed at a bottom side of the upper part 12 of the cooking hob 10. Preferably, the first portion 22 is glued at the upper part 12.

In this example the upper part 12 includes two bendings 18. Said bendings 18 are angled about 90° and associated with a section of a circumferential side of the upper part 12 of the cooking hob 10. The design element 16 encloses the upper part 12 of the cooking hob 10 along the circumferential side of said upper part 12.

The second portion 24 of the fastening element 20 extends substantially in a vertical plane, so that the bigger part of the fastening element 20 has the form of an L-profile. The second portion 24 of the fastening element 20 includes two spring elements 26 and a latch element 28. The latch element 28 is arranged between said two spring elements 26. The second portion 24 is arranged at an outer sidewall of the lower part 14 of the cooking hob 10. The spring elements 26 have a U-shaped form and are elastic. The spring elements 26 are provided to clamp the cooking hob 10 within a cutout. The elastic properties of the spring elements 26 act into a radial direction, i.e. perpendicular to the sidewall of the lower part 14. The latch element 28 includes an appendix 30 and a recess 42.

At the sidewall of the lower part 14 of the cooking hob 10 there is a lug element 32 engaged with the recess 42 of the latch element 28. The recess 42 is marginally bigger than the lug element 32. When the upper part 12 is set from above onto the lower part 14, then the lug element 32 is latched into the recess 42. The upper part 12 and the lower part 14 of the cooking hob 10 are jointed by at least two lug elements 32 and two associated recesses 42.

The appendix 30 of the latch element 28 is provided to pull the latch element 28 away from the lug element 32 and the sidewall of the lower part 14. Thus, the upper part 12 of the cooking hob 10 may be easily removed again from the lower part 14 of the cooking hob 10.

FIG. 2 illustrates a schematic diagram of a sectional side view of the fastening element 20 arranged at the cooking hob 10 within a cutout 34 of a worktop 36 according to the preferred embodiment of the present invention. In this example the upper part 12 is a glass-ceramic panel.

The upper part 12 of the cooking hob 10 is arranged above the lower part 14 of said cooking hob 10. The first portion 22 of the fastening element 20 is glued at the bottom side of the upper part 12. Each of the bendings 18 supports one section, respectively, of the circumferential side of the upper part 12. The upper part 12 and the lower part 14 of the cooking hob 10 are jointed by the engagement of the lug element 32 in the recess 42 of the latch element 28. The cooking hob 10 comprises at least two fastening elements 20. At least two of said fastening elements 20 are arranged at opposite sides of the cooking hob 10.

The cooking hob 10 is clamped by the spring elements 26 within the cutout 34 of the worktop 36. The worktop 36 is a part of a cabinet in a kitchen. The spring elements 26 press against the inner sides of the cutout 34.

In this example the circumference of the cutout 34 is marginally bigger than the circumference of the upper part 12 of the cooking hob 10. Thus, the cutout 34 encloses the upper part 12 along its circumferential side. Alternatively, the circumference of the upper part 12 may be marginally bigger than the circumference of the cutout 34, so that the upper part 12 of the cooking hob 10 is additionally supported by the worktop 36.

The design element 16 encloses the circumferential side of the upper part 12 of the cooking hob 10. The design element 16 is directly fixed at the upper part 12. The cooking hob 10 may be equipped with different design elements 16, so that the design of the cooking hob 10 may be easily varied. Preferably, the design element 16 has only optical purposes. Further, the design element 16 may be used to support the cooking hob 10. Additionally, the design element 16 may have a sealing function.

FIG. 3 illustrates a schematic diagram of a perspective view from a bottom side of the upper part 12 with a number of the fastening elements 20 according to the preferred embodiment of the present invention. The upper part 12 has a rectangular form and comprises eight fastening element 20. Each side of the upper part 12 comprises two fastening element 20.

Further, a sealing strip 38 is applied on the bottom side of the upper part 12. The sealing strip 38 is arranged along a substantially rectangular path. The path of the sealing strip 38 is adapted to the contour of an open casing 40, which is provided to be arranged at the bottom side of the upper part 12. The sealing strip 38 is applied automatically onto the bottom side of the upper part 12. Preferably, the sealing strip 38 is applied as a fluid or viscous paste onto the upper part 12.

The casing 40 may be provided for an electric or electronic circuitry. In this example the casing 40 is made of plastics. The plastic material of the casing 40 and the sealing strip 38 allow a leakproof arrangement of the electric or electronic circuitry. Thus, it is not necessary that the design element 16 has any sealing function.

FIG. 4 illustrates a detailed schematic diagram of the perspective view from the bottom side of the upper part 12 of the cooking hob 10 with one of the fastening elements according to FIG. 3. The sealing strip 38 is applied on the bottom side of the upper part 12. The fastening element 20 is glued onto the bottom side of the upper part 12 of the cooking hob 10. The design sign element 16 encloses the upper part 12 of the cooking hob 10.

A further sealing strip 44 is arranged under the design element 16. Said further sealing strip 44 is optional. If the components being sensitive to moisture are arranged within the casing 40 and sealed by the sealing strip 38, then it is not necessary to arrange any further sealing means.

FIG. 5 illustrates a detailed schematic diagram of the perspective view of the upper part 12 of the cooking hob 10 with two of the fastening elements 20 according to FIG. 3 and FIG. 4. The sealing strip 38 is applied on the bottom side of the upper part 12. FIG. 5 shows the path of the complete sealing strip 38. The fastening element 20 is glued onto the bottom side of the upper part 12 of the cooking hob 10.

The design element 16 encloses the upper part 12 of the cooking hob 10. The further sealing strip 44, which is optional, is arranged under the design element 16. However, it is not necessary to arrange the further sealing strip 44, if the electric or electronic circuitry is arranged within the casing 40 and sealed by the sealing strip 38.

FIG. 6 illustrates a detailed schematic diagram of the perspective view of the upper part 12 of the cooking hob 10 with the two fastening elements 20 according to FIG. 5 and the casing 40. FIG. 6 is the same perspective view of FIG. 5, wherein the casing 40 is added. The casing 40 is formed as a plastic shell. The open side of the casing 40 is covered by the bottom side of the upper part 12 of the cooking hob 10. The casing 40, the upper part 12 and the sealing strip 38 between them form a leakproof space.

FIG. 7 illustrates a schematic diagram of a partial sectional view of the casing 40 arranged at the upper part 12 of the cooking hob 10 according to the preferred embodiment of the present invention. The casing 40 has one open side. Said open side is arranged form-fit at the bottom side of the upper part 12. Between the bottom side of the upper part 12 and the border of the open side of the casing 40 there is the sealing strip 38. The dimension of the casing 40 is adapted to the electric or electronic circuitry. The path of the sealing strip 38 at the bottom side of the upper part 12 is adapted to the border of the open side of the casing 40.

FIG. 8 illustrates a schematic diagram of a sectional side view in a position of a fore spring element 26 showing the fastening element 20 arranged at the cooking hob 10 within the cutout 34 according to the preferred embodiment of the present invention.

The upper part 12 and the lower part 14 of the cooking hob 10 are connected by the fastening element 20. The first portion 22 of the fastening element 20 is glued at the bottom side of the upper part 12. The fastening element 20 and the lower part 14 of the cooking hob 10 are jointed by the engagement of the lug element 32 in the recess 42 of the latch element 28.

The cooking hob 10 is clamped by the spring elements 26 within the cutout 34 of the worktop 36. The spring elements 26 press against the inner sides of the cutout 34. The design element 16 encloses the circumferential side of the upper part 12 of the cooking hob 10. The design element 16 is directly fixed at the upper part 12. The cooking hob 10 may be equipped with different design elements 16, so that the design of the cooking hob 10 can easily be varied.

FIG. 9 illustrates a schematic diagram of a sectional side view in a position of a rearmost spring element 26 showing the fastening element 20 arranged at the cooking hob 10 within a cutout 34 according to the preferred embodiment of the present invention. FIG. 9 corresponds with FIG. 8. However, the latch element 28 with the appendix 30 as well as the lug element 32 are not shown, since the sectional line of FIG. 9 penetrates the rearmost spring element 26.

The fastening element 20 according to the present invention allows a simple and fast assembling of the upper part 12 and the lower part 14 on the one hand and a subsequent installation of the resulting cooking hob 10 within the cutout 34 of the worktop 36 on the other hand. The fastening element 20 according to the present invention has two different functions, namely the connection between the upper part 12 and the lower part 14 and the connection between the cooking hob 10 and the cutout 34. Two inventive fastening elements 20 are sufficient for a robust installing the two-part cooking hob 10 in the cutout 34 of the worktop 36.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking hob
12 upper part of the cooking hob, glass-ceramic panel
14 lower part of the cooking hob
16 design element
18 bending
20 fastening element
22 first portion of the fastening element
24 second portion of the fastening element
26 spring element
28 latch element
30 appendix
32 lug element
34 cutout
36 worktop
38 sealing strip
40 casing
42 recess
44 further sealing strip

The invention claimed is:

1. A one-piece fastening element for a cooking hob, comprising:

a first arm permanently attached to an underside of an upper part of the cooking hob;

a second arm detachably connectable to a sidewall of a lower part of the cooking hob, the second arm extending along the sidewall of the lower part of the cooking hob when connected to the upper part of the cooking hob, wherein the second arm comprises:

two end portions, each having a spring element biased away from the sidewall of the lower part of the cooking hob in order to clamp the cooking hob within a cutout enclosing circumferentially the cooking hob, and a middle portion separated from and between the two end portions, wherein the first arm of the fastening element and the second arm of the fastening element are formed at about 90 degrees and together form the one-piece fastening element, and when fastened together by the one-piece fastening element, the upper part and the lower part form the cooking hob.

2. The fastening element according to claim 1, wherein the first arm of the fastening element is glued to the underside of the upper part of the cooking hob.

3. The fastening element according to claim 1, wherein the first arm of the fastening element comprises a bending for supporting at least a section of a circumferential side of the upper part of the cooking hob.

4. The fastening element according to claim 1, wherein the middle portion of the second arm comprises an aperture with which a lug element on the sidewall of the lower part of the cooking hob is engageable.

5. The fastening element according to claim 1, wherein the spring elements are U-shaped and/or leaf-springs.

6. The fastening element according to claim 4, wherein the middle portion of the second arm further comprises a buckled appendix acting as a grip such that the middle portion is extendable away from the sidewall by pulling on the buckled appendix, thereby disengaging the lug element from the aperture.

7. The fastening element according to claim 4, wherein the upper part of the cooking hob is a glass-ceramic panel.

8. A cooking hob comprising:

at least two fastening elements according to claim 1;

the upper part of the cooking hob; and the lower part of the cooking hob, wherein, a first fastening element and a second fastening element of the at least two fastening elements are permanently attached to the upper part of the cooking hob such that the second arms of the first and second fastening elements are detachably connectable to opposite sidewalls of the lower part of the cooking hob, and wherein the spring elements of the first and second fastening elements have elastic properties which act in a radial direction away from their respective sidewalls of the lower part of the cooking hob so as to provide an elastic force in opposite directions and clamp the cooking hob within the cutout enclosing circumferentially the cooking hob.

* * * * *